US011904434B2

(12) United States Patent
Li et al.

(10) Patent No.: US 11,904,434 B2
(45) Date of Patent: Feb. 20, 2024

(54) VARIABLE SIZE WHEEL DEBURRING DEVICE

(71) Applicant: CITIC Dicastal Co., LTD, Qinhuangdao (CN)

(72) Inventors: Xueqiang Li, Qinhuangdao (CN); Bowen Xue, Qinhuangdao (CN); Jiandong Guo, Qinhuangdao (CN)

(73) Assignee: CITIC Dicastal Co., LTD, Qinhuangdao (CN)

( * ) Notice: Subject to any disclaimer, the term of this patent is extended or adjusted under 35 U.S.C. 154(b) by 1217 days.

(21) Appl. No.: 16/548,825

(22) Filed: Aug. 22, 2019

(65) Prior Publication Data

US 2020/0139504 A1 May 7, 2020

(30) Foreign Application Priority Data

Nov. 6, 2018 (CN) ..... 201811312740.3

(51) Int. Cl.

| | |
|---|---|
| ***B24B 9/04*** | (2006.01) |
| ***B24B 27/00*** | (2006.01) |
| ***B24B 41/02*** | (2006.01) |
| ***B24B 41/06*** | (2012.01) |
| ***B24B 47/12*** | (2006.01) |

(52) U.S. Cl.

CPC ..... *B24B 9/04* (2013.01); *B24B 27/0076* (2013.01); *B24B 41/02* (2013.01); *B24B 41/06* (2013.01); *B24B 47/12* (2013.01)

(58) Field of Classification Search

CPC ..... B24B 9/04; B24B 27/0076; B24B 27/033; B24B 27/0023; B24B 41/02; B24B 41/06; B24B 41/067; B24B 41/005; B24B 47/12; B24B 47/22; B24B 29/005; B24B 29/02; B24B 5/44; B23Q 3/06

See application file for complete search history.

(56) References Cited

U.S. PATENT DOCUMENTS

| | | | | |
|---|---|---|---|---|
| 10,010,992 | B2 * | 7/2018 | Xue | B24B 5/40 |
| 10,112,282 | B2 * | 10/2018 | Xue | B24B 5/44 |
| 10,160,085 | B2 * | 12/2018 | Xue | B24B 29/04 |
| 10,207,384 | B2 * | 2/2019 | Zheng | B24B 5/44 |
| 10,232,485 | B2 * | 3/2019 | Xue | B24B 21/006 |
| 10,232,486 | B2 * | 3/2019 | Xue | B24D 13/145 |
| 10,926,371 | B2 * | 2/2021 | Xu | B24B 27/0076 |
| 10,967,476 | B2 * | 4/2021 | Xu | B24B 27/0076 |
| 11,084,141 | B2 * | 8/2021 | Xu | B24B 5/44 |
| 11,396,077 | B2 * | 7/2022 | Li | B24B 41/02 |
| 11,471,992 | B2 * | 10/2022 | Zhang | B24B 41/067 |
| 11,534,883 | B2 * | 12/2022 | Zhang | B24B 5/44 |

* cited by examiner

*Primary Examiner* — Joel D Crandall
*Assistant Examiner* — Makena S Markman
(74) *Attorney, Agent, or Firm* — Yong Chen

(57) ABSTRACT

The present invention discloses a variable size wheel deburring device, which is composed of a lower lifting system, a central brush driving system, a brush system I, a brush system II and a clamping driving system. When used, the servo electric cylinder II, through the guiding rail II, causes the left and right rollers to clamp the lower wheel rim of the wheel; and the servo motor I can achieve the rotation of the clamped wheel by the pulley I, the pulley II and the synchronous belt I. The device according to the present invention in use can not only realize the burr removal of the wheel center hole, the flange root corner, the spoke edge and the rim corner, but also can adapt to wheel types of different size.

1 Claim, 4 Drawing Sheets

VARIABLE SIZE WHEEL DEBURRING DEVICE

CROSS-REFERENCE TO RELATED APPLICATIONS

The present application claims the priority of Chinese patent application No. 201811312740.3, filed on Nov. 6, 2018, which is hereby incorporated by reference in its entirety.

TECHNICAL FIELD

The present invention relates to a deburring device, and more particularly to a variable size wheel deburring device.

BACKGROUND

In the machining process of aluminum alloy wheels, due to the reasons of processing technology and the tool, it is inevitable that burrs will be generated at the wheel center hole, the flange root corner, the spoke edge and the rim corner. If these burrs are not removed in time, the subsequent coating effect will be seriously affected; due to structural constraints, for different treatment portions, the position of the brush needs to be adjusted to more effectively remove the burrs of these portions. At the same time, since the general wheel manufacturers produce in mixed-line, that is, the wheels of different sizes and different wheel widths will flow at the same time in the production line. Therefore, a device is needed to ensure the deburring effect while being able to adapt to the mixed line production.

SUMMARY

It is an object of the present invention to provide a variable size wheel deburring device which, in use, can not only achieve burr removal at the wheel center hole, the flange root corner, the spoke edge and the rim corner, but also can adapt to wheel types of different size.

In order to achieve the above object, the technical solution of the present invention is as follows: variable size wheel deburring device, comprises a frame, guiding posts I, cylinders I, servo electric cylinders I, a lifting plate I, a lifting plate II, guiding sleeves I, a guiding rail I, a pulling rod I, a guiding rail II, rollers, a carriage, a servo electric cylinder II, a pulley I, a synchronous belt I, pulleys II, a servo motor I, guiding posts II, a guiding sleeve II, a synchronous belt II, a pulley III, a servo motor II, a cylinder II, a rotary joint, a spline shaft, a pulley IV, a spline sleeve I, a bearing pedestal I, a hollow shaft, a bearing pedestal II, a ring-pull, an anti-rotation pin, a spring, a central bevel gear, a piston, a cylinder rod, a sealing end cap, a central brush, supporting frames I, a vertical brush, a bearing pedestal III, a shaft III, a bevel gear I, a bevel gear II, a shaft IV, a bearing pedestal IV, a round brush I, a spline sleeve II, a bevel gear III, a fixing frame I, a guiding rail III, a pulling rod II, supporting frames II, a transversal plate, servo electric cylinders III, guiding sleeves III, guiding posts III, a guiding rail IV, a slider, a lifting plate III, a fixing block, a servo electric cylinder IV, a connecting rod, an overturning plate, a diagonal brush, a shaft V, a cross hinge I, a shaft VI, a cross hinge II, a shaft VII, a bearing pedestal VII, a round brush II, a shaft VIII, a bearing pedestal VIII, a spline sleeve III, a bevel gear IV, a bevel gear V, a bevel gear VI and a fixing frame II.

The lower lifting system comprises: the four guiding posts I are fixed between the upper and lower bottom plates of the frame; the four guiding sleeves I cooperating with the guiding posts I are fixed on the lifting plate II; the two cylinders I are fixed on the bottom plate of the frame, and the output ends thereof are hinged to the lower part of the lifting plate II; the four guiding posts II are fixed below the lifting plate I, and the four guiding sleeves II cooperating with the guiding post II are fixed on the lifting plate II; the two servo electric cylinders I are fixed below the lifting plate II, and the output ends thereof are hinged to the lower part of the lifting plate I; the fixing frame I and the fixing frame II are fixed above the lifting plate I; the supporting frame I is mounted above the lifting plate I through the guiding rail I; and the supporting frame II is also mounted above the lifting plate I through the guiding rail III.

The central brush driving system comprises: the bearing pedestal I is fixed below the lifting plate II; the spline sleeve I is mounted inside the bearing pedestal I through a bearing; the pulley IV is fixed below the spline sleeve I; the spline below the spline shaft is matched with the spline sleeve I; the cylinder II is fixed below the bearing pedestal I, and the output end thereof is connected to the lower part of the rotary joint; the upper part of the rotary joint is connected to the lower end of the spline shaft; the servo motor II is fixed on the right side below the lifting plate II through a transition flange, and the output end thereof is fixed with the pulley III; the pulley III and the pulley IV are connected by the synchronous belt II; the bearing pedestal II is fixed above the lifting plate I; the hollow shaft is mounted inside of the bearing pedestal II through a bearing; the upper part of the spline shaft is a smooth shaft; the hollow shaft is clearance matched with the smooth shaft that is the upper part of the spline shaft; the ring-pull is fixed above the bearing pedestal II; the top end of the hollow shaft has an opening groove which is matched with the anti-rotation pin fixed above the spline shaft; the spring is sleeved on the outer side of the upper part of the spline shaft, and is placed between the anti-rotation pin and the central bevel gear; the top end of the spline shaft is matched with the hole that is in the lower part of the central bevel gear; the piston is matched with the hole that is in the upper part of the central bevel gear; the cylinder rod is fixed on the upper part of the piston; the inner hole of the sealing end cap is matched with the cylinder rod, and is fixed on the top end of the central bevel gear; the upper inner bore of the central bevel gear, the piston, the cylinder rod and the sealing end cap form a self-made cylinder; and the central brush is fixed on the top end of the sealing end cap.

The brush system I comprises: the bearing pedestal III is fixed above the supporting frame I; the shaft III is mounted inside the bearing pedestal III through a bearing; the bevel gear I is fixed on the left side of the shaft III; the bearing pedestal IV is fixed on the top end of the supporting frame I; the shaft IV is mounted inside the bearing pedestal IV through a bearing; the round brush I is fixed on the top end of the shaft IV; the bevel gear II is fixed below the shaft IV; the bevel gear I is meshed with the bevel gear II, and the angle between them is 90 degrees; the vertical brush is fixed at the middle of the shaft III, and is placed on the right side of the bearing pedestal III; the spline sleeve II is mounted on the top end of the fixing frame I through a bearing; the bevel gear III is fixed on the right side of the spline sleeve II; and the bevel gear III is meshed with the top end of the central bevel gear, and the angle between them is 90 degrees. The present device comprises two sets of symmetrical brush systems I on the left and right.

The brush system II comprises: the transversal plate is fixed on the left side of the supporting frame II; the four guiding posts III are fixed below the lifting plate III; the four guiding sleeves III matched with the guiding post III are fixed on the transversal plate; the two servo electric cylinders III is fixed below the transversal plate, and the output end thereof is connected to the lower part of the lifting plate III; the slider is mounted on the top end of the lifting plate III through the guiding rail IV; the servo electric cylinder IV is fixed on the left side above the lifting plate III, and the output end thereof is connected to the slider; the fixing block is also fixed above the lifting plate III; the lower part of the overturning plate is hinged to the upper part of the slider; the two ends of the connecting rod are respectively hinged to the fixing block and the overturning plate; the shaft V is mounted above the overturning plate through a bearing; the diagonal brush is fixed on the left side of the shaft V; the right side of the shaft V is connected to the left side of the cross hinge I; the left side of the shaft VI and the right side of the cross hinge I; the right side of the shaft VI is connected to the left side of the cross hinge II; the right side of the cross hinge II is connected to the left side of the shaft VII; the shaft VII is mounted inside the bearing pedestal VII through a bearing; the bearing pedestal VII is fixed on the upper end of the supporting frame II; the bevel gear VI is fixed on the middle position of the shaft VII; the bearing pedestal VIII is fixed on the top end of the supporting frame II; the shaft VIII is mounted inside the bearing pedestal VIII through a bearing; the round brush II is fixed on the top end of the shaft VIII; the bevel gear V is fixed on the lower end of the shaft VIII; the bevel gear V is meshed with the bevel gear VI, and the angle between them is 90 degrees; the spline sleeve III bearing is mounted on the upper end of the fixing frame II; the bevel gear IV is fixed on the right side of the spline sleeve III; and the right side of the shaft VII is a splined shaft, which is matched with the inner hole of the spline sleeve III.

The two ends of the pulling rod I are respectively connected with the supporting frame I and the ring-pull; the two ends of the pulling rod II are respectively connected with the supporting frame II and the ring-pull; the rotation of the ring-pull can realize a synchronous movement of the two supporting frames I and two supporting frames II.

The clamping driving system comprises: the carriage is mounted above the top plate of the frame through the guiding rail II; the two rollers are mounted inside the carriage through bearings; the pulleys II are respectively fixed above the two rollers; the servo motor I is fixed on the top end of the carriage, and the output end thereof is fixed with the pulley I; the pulley I and the two pulleys II are connected by the synchronous belt I; and the servo electric cylinder II is fixed on the left side of the carriage, and the output end thereof is connected to the side of the frame. The present device comprises two sets of symmetrical clamping driving systems on the left and right.

During operation, the servo electric cylinder II causes the left and right rollers to clamp the lower wheel rim of the wheel through the guiding rail II; and the servo motor I can, by the pulley I, the pulley II and the synchronous belt I, achieve the rotation of the clamped wheel.

The servo motor II drives the spline sleeve I and the spline shaft to rotate through the pulley III, the pulley IV and the synchronous belt II, thereby driving the central bevel gear and the central brush to rotate; the cylinders I achieve the initial lifting of the central brush driving system, the brush system I and the brush system II through the guiding posts I and the guiding sleeves I; and the precise adjustment of the upper and lower positions of the central brush can be achieved by the piston, the cylinder rod and the sealing end cap, and the burrs at the center hole of the wheel can be removed when the rotating central brush contacts here.

The rotating central bevel gear drives the spline sleeve II to rotate through the bevel gear III; the spline sleeve II can drive the vertical brush and the bevel gear I to rotate by matching with the spline portion on the right side of the shaft III; the meshing of the bevel gear I and the bevel gear II can achieve the rotation of the shaft IV and the round brush I; the rotating central bevel gear drives the spline sleeve III to rotate through the bevel gear IV; the spline sleeve III can drive the shaft VII and the bevel gear VI to rotate by matching with the spline portion on the right side of the shaft VII; the bevel gear VI can achieve the rotation of the shaft VIII and the round brush II by meshing with the bevel gear V; the shaft VII can drive the shaft V to rotate through the cross hinge I, the shaft VI and the cross hinge II; the V can drive the diagonal brush to rotate; the servo electric cylinder IV can adjust the angles of the overturning plate and the diagonal brush through the slider, the guiding rail IV and the connecting rod; the servo electric cylinders III can achieve the upper and lower adjustment of the brush through the guiding posts III and the guiding sleeves III; the servo electric cylinders I can achieve the precise adjustment of the upper and lower positions of the vertical brush, the round brush I, the round brush II and the diagonal brush through the guiding post II and the guiding sleeve II; the spring can ensure that the bevel gear is always meshed with the bevel gear III and the bevel gear IV; and when the rotating vertical brush, the rotating round brush I, the rotating round brush II and the rotating diagonal brush are in contact with the wheel back cavity, the burrs at the flange root corners of the back cavity, the spoke edges, and the rim corners can be removed.

The cylinder II pulls down the spline shaft, so that the anti-rotation pin is matched with the opening groove at the top end of the hollow shaft; the rotation of the ring-pull can be driven by the rotation of the spline shaft; and through the pulling rod I, the guiding rail I, the pulling rod II and the guiding rail III, the synchronous adjustment of the positions of the vertical brush, the round brush I, the round brush II and the diagonal brush can be achieved.

The invention in use can not only realize the burr removal of the wheel center hole, the flange root corner, the spoke edge and the rim corner, but also can adapt to wheel types of different size.

DETAILED DESCRIPTION

Figure 1:
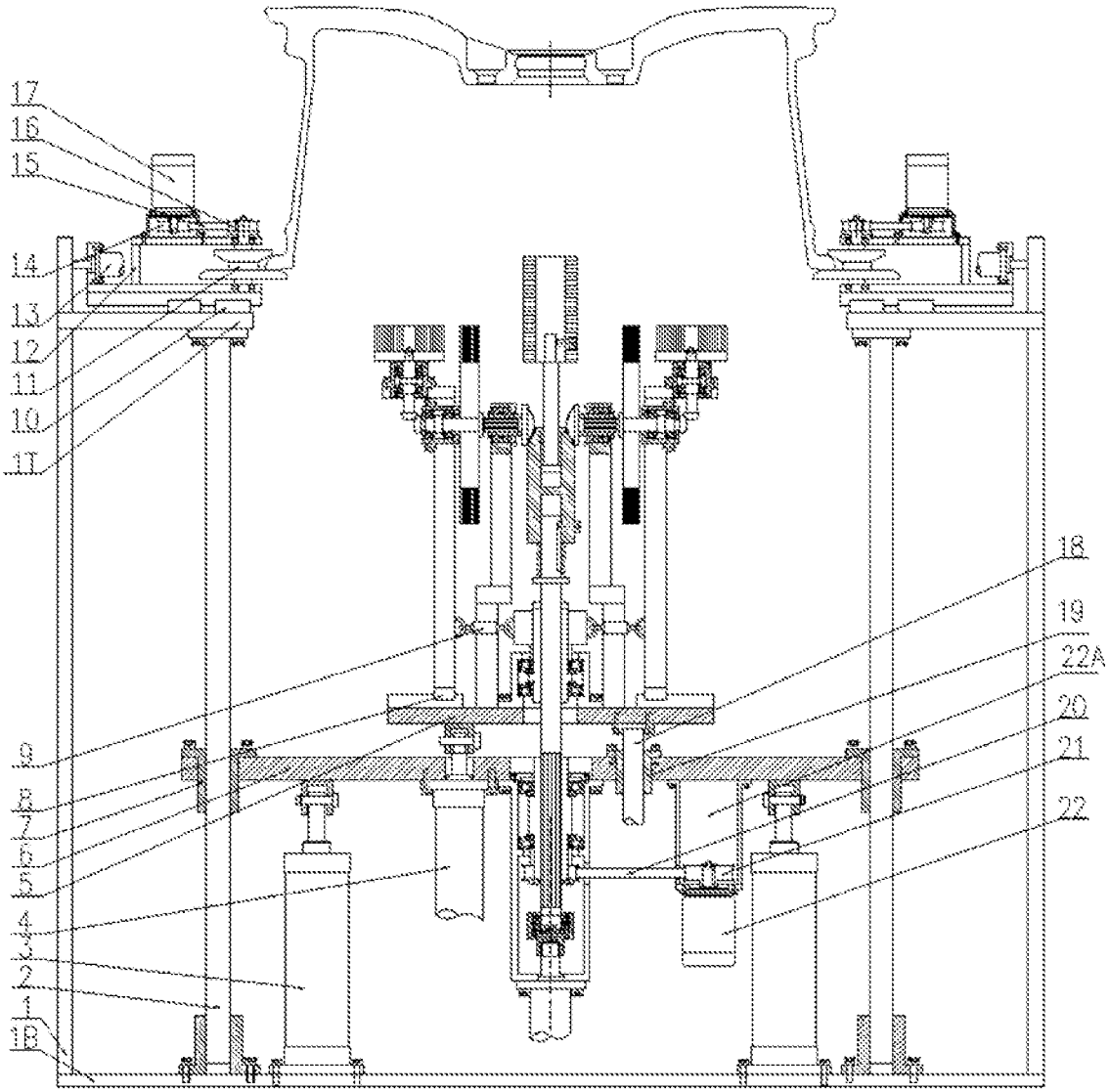
FIG. 1 is the main view of the variable size wheel deburring device of the present invention.
Figure 2:
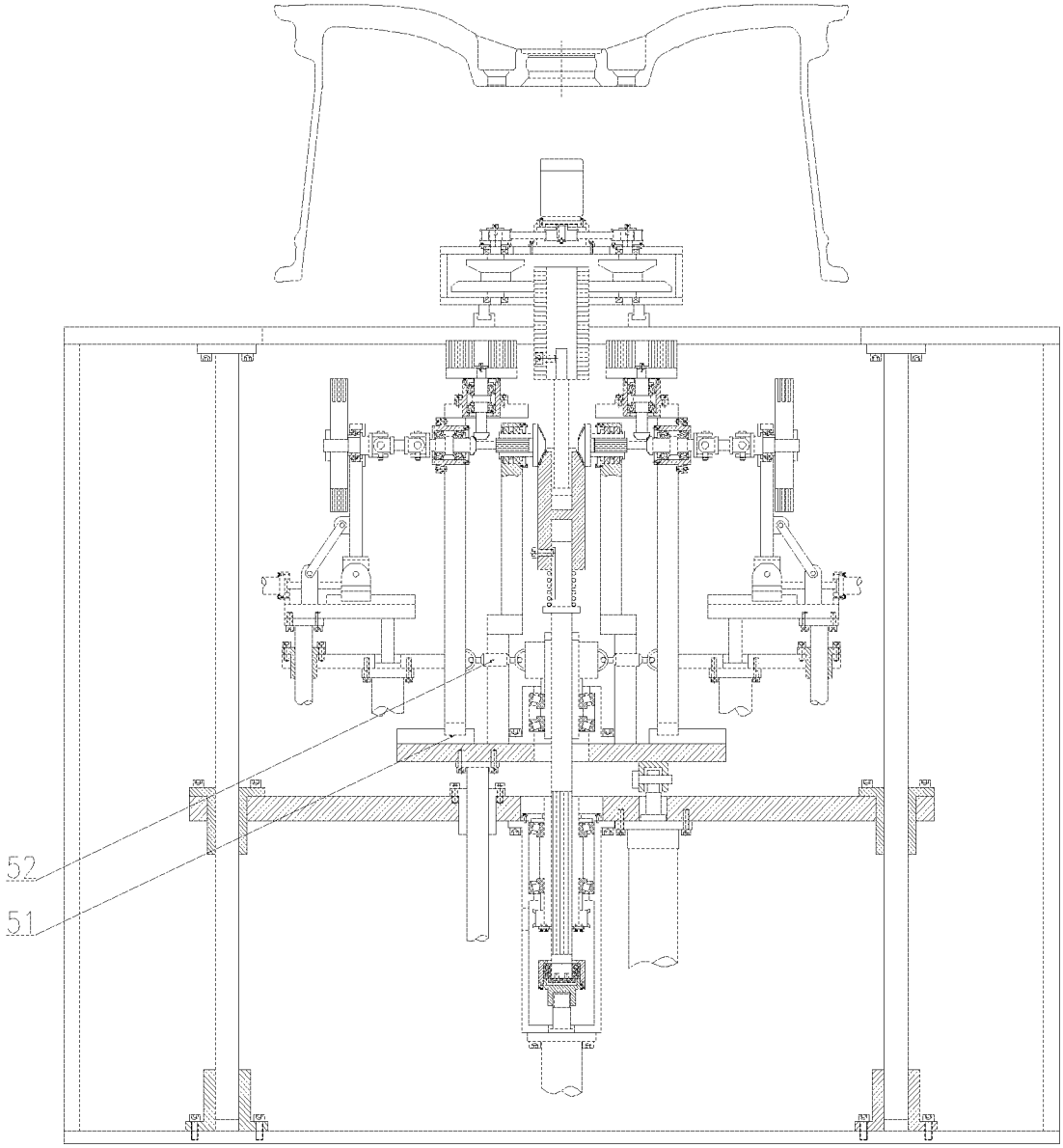
FIG. 2 is the partial left view of variable size wheel deburring device
Figure 3:
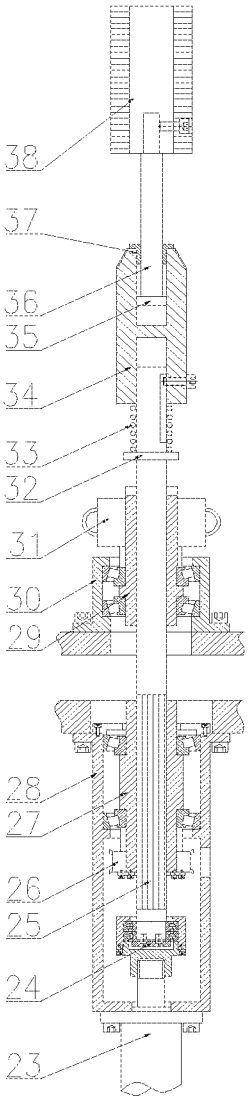
FIG. 3 is the main view of the central brush driving system of variable size wheel deburring device
Figure 4:
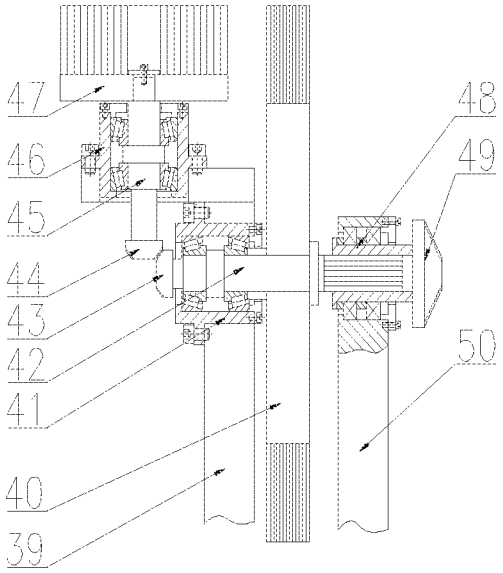
FIG. 4 is the main view of the brush system I of variable size wheel deburring device.
Figure 5:
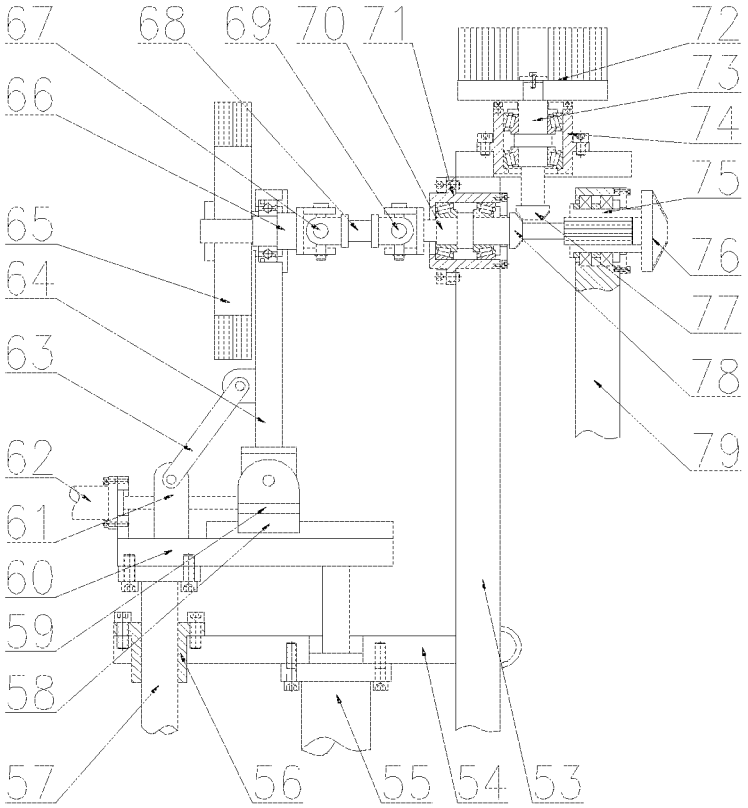
FIG. 5 is the main view of the brush system II of variable size wheel deburring device.

The details and operation of the specific device according to the present invention will be described below with reference to the accompanying drawings.

The device comprises a frame 1, guiding posts I 2, cylinders I 3, servo electric cylinders I 4, a lifting plate I 5, a lifting plate II 6, guiding sleeves I 7, a guiding rail I 8, a pulling rod I 9, a guiding rail II 10, rollers 11, a carriage 12, a servo electric cylinder II 13, a pulley I 14, a synchronous belt I 15, pulleys II 16, a servo motor I 17, guiding posts II 18, a guiding sleeve II 19, a synchronous belt II 20, a pulley III 21, a servo motor II 22, a cylinder II 23, a rotary joint 24, a spline shaft 25, a pulley IV 26, a spline sleeve I 27, a bearing pedestal I 28, a hollow shaft 29, a bearing pedestal II 30, a ring-pull 31, an anti-rotation pin 32, a spring 33, a central bevel gear 34, a piston 35, a cylinder rod 36, a sealing end cap 37, a central brush 38, supporting frames I 39, a vertical brush 40, a bearing pedestal III 41, a shaft III 42, a bevel gear I 43, a bevel gear II 44, a shaft IV 45, a bearing pedestal IV 46, a round brush I 47, a spline sleeve II 48, a bevel gear III 49, a fixing frame I 50, a guiding rail III 51, a pulling rod II 52, supporting frames II 53, a transversal plate 54, servo electric cylinders III 55, guiding sleeves III 56, guiding posts III 57, a guiding rail IV 58, a slider 59, a lifting plate III 60, a fixing block 61, a servo electric cylinder IV 62, a connecting rod 63, an overturning plate 64, a diagonal brush 65, a shaft V 66, a cross hinge I 67, a shaft VI 68, a cross hinge II 69, a shaft VII 70, a bearing pedestal VII 71, a round brush II 72, a shaft VIII 73, a bearing pedestal VIII 74, a spline sleeve III 75, a bevel gear IV 76, a bevel gear V 77, a bevel gear VI 78 and a fixing frame II 79.

The lower lifting system comprises: the four guiding posts I 2 are fixed between the upper plate IT and lower bottom plate 1B of the frame 1; the four guiding sleeves I 7 cooperating with the guiding posts I 2 are fixed on the lifting plate II 6; the two cylinders I 3 are fixed on the bottom plate of the frame 1, and the output ends thereof are hinged to the lower part of the lifting plate II 6; the four guiding posts II 18 are fixed below the lifting plate I 5, and the four guiding sleeves II 19 cooperating with the guiding post II 18 are fixed on the lifting plate II 6; the two servo electric cylinders I 4 are fixed below the lifting plate II 6, and the output ends thereof are hinged to the lower part of the lifting plate I 5; the fixing frame I 50 and the fixing frame II 79 are fixed above the lifting plate I 5; the supporting frame I 39 is mounted above the lifting plate I 5 through the guiding rail I 8; and the supporting frame II 53 is also mounted above the lifting plate I 5 through the guiding rail III 51.

The central brush driving system comprises: the bearing pedestal I 28 is fixed below the lifting plate II 6; the spline sleeve I 27 is mounted inside the bearing pedestal I 28 through a bearing; the pulley IV 26 is fixed below the spline sleeve I 27; the spline below the spline shaft 25 is matched with the spline sleeve I 27; the cylinder II 23 is fixed below the bearing pedestal I 28, and the output end thereof is connected to the lower part of the rotary joint 24; the upper part of the rotary joint 24 is connected to the lower end of the spline shaft 25; the servo motor II 22 is fixed on the right side below the lifting plate II 6 through a transition FIG. 22A, and the output end thereof is fixed with the pulley III 21; the pulley III 21 and the pulley IV 26 are connected by the synchronous belt II 20; the bearing pedestal II 30 is fixed above the lifting plate I 5; the hollow shaft 29 is mounted inside of the bearing pedestal II 30 through a bearing; the upper part of the spline shaft 25 is a smooth shaft; the hollow shaft 29 is clearance matched with the smooth shaft that is the upper part of the spline shaft 25; the ring-pull 31 is fixed above the bearing pedestal II 30; the top end of the hollow shaft 29 has an opening groove which is matched with the anti-rotation pin 32 fixed above the spline shaft 25; the spring 33 is sleeved on the outer side of the upper part of the spline shaft 25, and is placed between the anti-rotation pin 32 and the central bevel gear 34; the top end of the spline shaft 25 is matched with the hole that is in the lower part of the central bevel gear 34; the piston 35 is matched with the hole that is in the upper part of the central bevel gear 34; the cylinder rod 36 is fixed on the upper part of the piston 35; the inner hole of the sealing end cap 37 is matched with the cylinder rod 36, and is fixed on the top end of the central bevel gear 34; the upper inner bore of the central bevel gear 34, the piston 35, the cylinder rod 36 and the sealing end cap 37 form a self-made cylinder; and the central brush 38 is fixed on the top end of the sealing end cap 37.

The brush system I comprises: the bearing pedestal III 41 is fixed above the supporting frame I 39; the shaft III 42 is mounted inside the bearing pedestal III 41 through a bearing; the bevel gear I 43 is fixed on the left side of the shaft III 42; the bearing pedestal IV 46 is fixed on the top end of the supporting frame I 39; the shaft IV 45 is mounted inside the bearing pedestal IV 46 through a bearing; the round brush I 47 is fixed on the top end of the shaft IV 45; the bevel gear II 44 is fixed below the shaft IV 45; the bevel gear I 43 is meshed with the bevel gear II 44, and the angle between them is 90 degrees; the vertical brush 40 is fixed at the middle of the shaft III 42, and is placed on the right side of the bearing pedestal III 41; the spline sleeve II 48 is mounted on the top end of the fixing frame I 50 through a bearing; the bevel gear III 49 is fixed on the right side of the spline sleeve II 48; and the bevel gear III 49 is meshed with the top end of the central bevel gear 34, and the angle between them is 90 degrees. The present device comprises two sets of symmetrical brush systems I on the left and right.

The brush system II comprises: the transversal plate 54 is fixed on the left side of the supporting frame II 53; the four guiding posts III 57 are fixed below the lifting plate III 60; the four guiding sleeves III 56 matched with the guiding post III 57 are fixed on the transversal plate 54; the two servo electric cylinders III 55 is fixed below the transversal plate 54, and the output end thereof is connected to the lower part of the lifting plate III 60; the slider 59 is mounted on the top end of the lifting plate III 60 through the guiding rail IV 58; the servo electric cylinder IV 62 is fixed on the left side above the lifting plate III 60, and the output end thereof is connected to the slider 59; the fixing block 61 is also fixed above the lifting plate III 60; the lower part of the overturning plate 64 is hinged to the upper part of the slider 59; the two ends of the connecting rod 63 are respectively hinged to the fixing block 61 and the overturning plate 64; the shaft V 66 is mounted above the overturning plate 64 through a bearing; the diagonal brush 65 is fixed on the left side of the shaft V 66; the right side of the shaft V 66 is connected to the left side of the cross hinge I 67; the left side of the shaft VI 68 and the right side of the cross hinge I 67; the right side of the shaft VI 68 is connected to the left side of the cross hinge II 69; the right side of the cross hinge II 69 is connected to the left side of the shaft VII 70; the shaft VII 70 is mounted inside the bearing pedestal VII 71 through a bearing; the bearing pedestal VII 71 is fixed on the upper end of the supporting frame II 53; the bevel gear VI 78 is fixed on the middle position of the shaft VII 70; the bearing pedestal VIII 74 is fixed on the top end of the supporting frame II 53; the shaft VIII 73 is mounted inside the bearing pedestal VIII 74 through a bearing; the round brush II 72 is fixed on the top end of the shaft VIII 73; the bevel gear V 77 is fixed on the lower end of the shaft VIII 73; the bevel gear V77 is meshed with the bevel gear VI 78, and the angle between them is 90 degrees; the spline sleeve III 75 bearing is mounted on the upper end of the fixing frame II 79; the bevel gear IV 76 is fixed on the right side of the spline sleeve III 75; and the right side of the shaft VII 70 is a splined shaft, which is matched with the inner hole of the spline sleeve III 75.

The two ends of the pulling rod I 9 are respectively connected with the supporting frame I 39 and the ring-pull 31; the two ends of the pulling rod II 52 are respectively connected with the supporting frame II 53 and the ring-pull 31; the rotation of the ring-pull 31 can realize a synchronous movement of the two supporting frames I 39 and two supporting frames II 53.

The clamping driving system comprises: the carriage 12 is mounted above the top plate of the frame 1 through the guiding rail II 10; the two rollers 11 are mounted inside the carriage 12 through bearings; the pulleys II 16 are respectively fixed above the two rollers 11; the servo motor I 17 is fixed on the top end of the carriage 12, and the output end thereof is fixed with the pulley I 14; the pulley I 14 and the two pulleys II 16 are connected by the synchronous belt I 15; and the servo electric cylinder II 13 is fixed on the left side of the carriage 12, and the output end thereof is connected to the side of the frame 1. The present device comprises two sets of symmetrical clamping driving systems on the left and right.

During operation, the servo electric cylinder II 13 causes the left and right rollers 11 to clamp the lower wheel rim of the wheel through the guiding rail II 10; and the servo motor I 17 can, by the pulley I 14, the pulley II 16 and the synchronous belt I 15, achieve the rotation of the clamped wheel.

The servo motor II 22 drives the spline sleeve I 27 and the spline shaft 25 to rotate through the pulley III 21, the pulley IV 26 and the synchronous belt II 20, thereby driving the central bevel gear 34 and the central brush 38 to rotate; the cylinders I 3 achieve the initial lifting of the central brush driving system, the brush system I and the brush system II through the guiding posts I 2 and the guiding sleeves I 7; and the precise adjustment of the upper and lower positions of the central brush 38 can be achieved by the piston 35, the cylinder rod 36 and the sealing end cap 37, and the burrs at the center hole of the wheel can be removed when the rotating central brush 38 contacts here.

The rotating central bevel gear 34 drives the spline sleeve II 48 to rotate through the bevel gear III 49; the spline sleeve II 48 can drive the vertical brush 40 and the bevel gear I 43 to rotate by matching with the spline portion on the right side of the shaft III 42; the meshing of the bevel gear I 43 and the bevel gear II 44 can achieve the rotation of the shaft IV 45 and the round brush I 47; the rotating central bevel gear 34 drives the spline sleeve III 75 to rotate through the bevel gear IV 76; the spline sleeve III 75 can drive the shaft VII 70 and the bevel gear VI 78 to rotate by matching with the spline portion on the right side of the shaft VII 70; the bevel gear VI 78 can achieve the rotation of the shaft VIII 73 and the round brush II 72 by meshing with the bevel gear V77; the shaft VII 70 can drive the shaft V 66 to rotate through the cross hinge I 67, the shaft VI 68 and the cross hinge II 69; the V 66 can drive the diagonal brush 65 to rotate; the servo electric cylinder IV 62 can adjust the angles of the overturning plate 64 and the diagonal brush 65 through the slider 59, the guiding rail IV 58 and the connecting rod 63; the servo electric cylinders III 55 can achieve the upper and lower adjustment of the brush 65 through the guiding posts III 57 and the guiding sleeves III 56; the servo electric cylinders I 4 can achieve the precise adjustment of the upper and lower positions of the vertical brush 40, the round brush I 47, the round brush II 72 and the diagonal brush 65 through the guiding post II 18 and the guiding sleeve II 19; the spring 33 can ensure that the bevel gear 34 is always meshed with the bevel gear III 49 and the bevel gear IV 76; and when the rotating vertical brush 40, the rotating round brush I 47, the rotating round brush II 72 and the rotating diagonal brush 65 are in contact with the wheel back cavity, the burrs at the flange root corners of the back cavity, the spoke edges, and the rim corners can be removed.

The cylinder II 23 pulls down the spline shaft 25, so that the anti-rotation pin 32 is matched with the opening groove at the top end of the hollow shaft 29; the rotation of the ring-pull 31 can be driven by the rotation of the spline shaft 25; and through the pulling rod I 9, the guiding rail I 8, the pulling rod II 52 and the guiding rail III 51, the synchronous adjustment of the positions of the vertical brush 40, the round brush I 47, the round brush II 72 and the diagonal brush 65 can be achieved.

The invention claimed is:

1. A variable size wheel deburring device, comprising:

a frame, four guiding posts I, two cylinders I, two servo electric cylinders I, a lifting plate I, a lifting plate II, four guiding sleeves I, a guiding rail I, a pulling rod I, a guiding rail II, two rollers, a carriage, a servo electric cylinder II, a pulley I, a synchronous belt I, two pulleys II, a servo motor I, four guiding posts II, four guiding sleeves II, a synchronous belt II, a pulley III, a servo motor II, a cylinder II, a rotary joint, a spline shaft, a pulley IV, a spline sleeve I, a bearing pedestal I, a hollow shaft, a bearing pedestal II, a ring-pull, an anti-rotation pin, a spring, a central bevel gear, a piston, a cylinder rod, a sealing end cap, a central brush, two supporting frames I, a vertical brush, a bearing pedestal III, a shaft III, a bevel gear I, a bevel gear II, a shaft IV, a bearing pedestal IV, a round brush I, a spline sleeve II, a bevel gear III, a fixing frame I, a guiding rail III, a pulling rod II, two supporting frames II, a transversal plate, two servo electric cylinders III, guiding sleeves III, guiding posts III, a guiding rail IV, a slider, a lifting plate III, a fixing block, a servo electric cylinder IV, a connecting rod, an overturning plate, a diagonal brush, a shaft V, a cross hinge I, a shaft VI, a cross hinge II, a shaft VII, a bearing pedestal VII, a round brush II, a shaft VIII, a bearing pedestal VIII, a spline sleeve III, a bevel gear IV, a bevel gear V, a bevel gear VI and a fixing frame II, wherein:

a lower lifting system comprises:

the four guiding posts I are fixed between an upper bottom plate and a lower bottom plate of the frame;

each of the four guiding sleeves I cooperate with one of the four guiding posts I, wherein the four guiding sleeves I are fixed on the lifting plate II;

the two cylinders I are fixed on the bottom plate of the frame, and an output end of each of the two cylinders I is hinged to the lower part of the lifting plate II;

the four guiding posts II are fixed below the lifting plate I, and each of the four guiding sleeves II cooperate with one of the four guiding posts II, wherein the four guiding sleeves II are fixed on the lifting plate II;

the two servo electric cylinders I are fixed below the lifting plate II, and an output end of each of two servo electric cylinders I is hinged to the lower part of the lifting plate I;

the fixing frame I and the fixing frame II are fixed above the lifting plate I;

the supporting frame I is mounted above the lifting plate I through the guiding rail I; and the supporting frame II is also mounted above the lifting plate I through the guiding rail III;

a central brush driving system comprises:

the bearing pedestal I is fixed below the lifting plate II;

the spline sleeve I is mounted inside the bearing pedestal I through a first bearing;

the pulley IV is fixed below the spline sleeve I;

the spline below the spline shaft is matched with the spline sleeve I;

the cylinder II is fixed below the bearing pedestal I, and an output end of the cylinder II is connected to the lower part of the rotary joint;

the upper part of the rotary joint is connected to the lower end of the spline shaft;

the servo motor II is fixed on the right side of the lifting plate II below the lifting plate II through a transition flange, and an output end of the servo motor II is fixed with the pulley III;

the pulley III and the pulley IV are connected by the synchronous belt II;

the bearing pedestal II is fixed above the lifting plate I;

the hollow shaft is mounted inside of the bearing pedestal II through a second bearing; the upper part of the spline shaft is a smooth shaft;

the hollow shaft is clearance matched with the smooth shaft that is the upper part of the spline shaft;

the ring-pull is fixed above the bearing pedestal II;

the top end of the hollow shaft has an opening groove which is matched with the anti-rotation pin fixed above the spline shaft;

the spring is sleeved on the outer side of the upper part of the spline shaft, and is placed between the anti-rotation pin and the central bevel gear;

the top end of the spline shaft is matched with a hole that is in the lower part of the central bevel gear;

the piston is matched with a hole that is in the upper part of the central bevel gear;

the cylinder rod is fixed on the upper part of the piston;

an inner hole of the sealing end cap is matched with the cylinder rod, and is fixed on the top end of the central bevel gear;

the hole that is in the upper part of the central bevel gear, the piston, the cylinder rod and the sealing end cap form a power cylinder; and the central brush is fixed on the top end of the sealing end cap;

a brush system I comprises:

the bearing pedestal III is fixed above the supporting frame I;

the shaft III is mounted inside the bearing pedestal III through a third bearing;

the bevel gear I is fixed on the left side of the shaft III;

the bearing pedestal IV is fixed on the top end of the supporting frame I;

the shaft IV is mounted inside the bearing pedestal IV through a fourth bearing;

the round brush I is fixed on the top end of the shaft IV;

the bevel gear II is fixed below the shaft IV;

the bevel gear I is meshed with the bevel gear II, and the angle between the bevel gear I and the bevel gear II is 90 degrees;

the vertical brush is fixed at the middle of the shaft III, and is placed on the right side of the bearing pedestal III;

the spline sleeve II is mounted on the top end of the fixing frame I through a fifth bearing;

the bevel gear III is fixed on the right side of the spline sleeve II; and the bevel gear III is meshed with the top end of the central bevel gear, and the angle between the bevel gear III and the central bevel gear is 90 degrees;

the variable size wheel deburring device comprises two symmetrical brush systems I, wherein each brush system I is respectively located on the left side and right side of the central brush;

a brush system II comprises:

the transversal plate is fixed on the left side of the supporting frame II;

at least one guiding post III is fixed below the lifting plate III;

at least one guiding sleeve III matches with the guiding post III, wherein the guiding sleeve III is fixed on the transversal plate;

at least one servo electric cylinder III is fixed below the transversal plate, and an output end of each of the servo electric cylinder III is connected to the lower part of the lifting plate III;

the slider is mounted on the top end of the lifting plate III through the guiding rail IV;

the servo electric cylinder IV is fixed on the left side above the lifting plate III, and an output end of the servo electric cylinder IV is connected to the slider;

the fixing block is fixed above the lifting plate III;

the lower part of the overturning plate is hinged to the upper part of the slider;

a first end of the connecting rod is hinged to the fixing block, and a second end of the connecting rod is hinged to the overturning plate;

the shaft V is mounted above the overturning plate through a sixth bearing; the diagonal brush is fixed on the left side of the shaft V;

the right side of the shaft V is connected to the left side of the cross hinge I;

the left side of the shaft VI is connected to and-the right side of the cross hinge I;

the right side of the shaft VI is connected to the left side of the cross hinge II;

the right side of the cross hinge II is connected to the left side of the shaft VII;

the shaft VII is mounted inside the bearing pedestal VII through a seventh bearing;

the bearing pedestal VII is fixed on the upper end of the supporting frame II;

the bevel gear VI is fixed on the middle position of the shaft VII;

the bearing pedestal VIII is fixed on the top end of the supporting frame II;

the shaft VIII is mounted inside the bearing pedestal VIII through an eighth bearing;

the round brush II is fixed on the top end of the shaft VIII; the bevel gear V is fixed on the lower end of the shaft VIII;

the bevel gear V is meshed with the bevel gear VI, and the angle between the bevel gear V and the bevel gear VI is 90 degrees;

the spline sleeve III bearing is mounted on the upper end of the fixing frame II;

the bevel gear IV is fixed on the right side of the spline sleeve III; and the right side of the shaft VII is a splined shaft, wherein the splined shaft of the shaft VII is matched with an inner hole of the spline sleeve III;

the variable size wheel deburring device comprises two symmetrical brush systems II, wherein each brush system II is respectively located on the front side and rear side of the central brush;

a first end of the pulling rod I is connected with the supporting frame I, and a second end of the pulling rod I is connecting with the ring-pull;

the rotation of the ring-pull is able to synchronously move the two supporting frames I and two supporting frames II;

a clamping driving system comprises:

the carriage is mounted above the top plate of the frame through the guiding rail II;

the two rollers are mounted inside the carriage through a plurality of bearings;

each of the pulleys II are fixed above one of each of the two rollers;

the servomotor I is fixed on the top end of the carriage, and an output end of the servo motor is fixed with the pulley I;

the pulley I and the two pulleys II are connected by the synchronous belt I; and the servo electric cylinder II is fixed on the left side of the carriage, and an output end of the servo electric cylinder II is connected to the side of the frame; and the variable size wheel deburring device comprises two symmetrical clamping driving systems, wherein each clamping system is respectively located on the left side and right side of the central brush.

* * * * *